US007854563B2

(12) United States Patent
Erskine

(10) Patent No.: US 7,854,563 B2
(45) Date of Patent: Dec. 21, 2010

(54) JOINT SYSTEM

(75) Inventor: Edward J. Erskine, Benson, NY (US)

(73) Assignee: Taylor Made Group, LLC, Gloversville, NY (US)

( * ) Notice: Subject to any disclaimer, the term of this patent is extended or adjusted under 35 U.S.C. 154(b) by 0 days.

(21) Appl. No.: 10/971,081

(22) Filed: Oct. 25, 2004

(65) Prior Publication Data

US 2006/0088372 A1 Apr. 27, 2006

(51) Int. Cl.
*F16D 3/00* (2006.01)

(52) U.S. Cl. ..... 403/122; 285/261; 248/288.31

(58) Field of Classification Search ..... 403/122–144, 403/277, 280, 283, 274, 113–116, 53, 57, 403/60, 161; 114/361; 285/146.1, 261, 146.2, 285/907, 146.3, 184, 263, 278, 280; 248/288.31, 248/296.1; 138/119, 120
See application file for complete search history.

(56) References Cited

U.S. PATENT DOCUMENTS

| | | | | | |
|---|---|---|---|---|---|
| 2,432,278 | A * | 12/1947 | Bratz | 52/726.1 |
| 2,448,494 | A * | 8/1948 | Moser | 248/123.11 |
| 2,476,850 | A * | 7/1949 | Fiori et al. | 403/57 |
| 2,739,780 | A * | 3/1956 | Richards | 248/324 |
| 2,985,467 | A * | 5/1961 | Cable, Jr. et al. | 285/145.3 |
| 3,278,203 | A * | 10/1966 | Snyder | 285/138.1 |
| 3,475,079 | A * | 10/1969 | Stricker | 359/615 |
| 3,874,706 | A * | 4/1975 | Arnold | 285/24 |
| 4,088,348 | A * | 5/1978 | Shemtov | 285/184 |
| 4,155,670 | A * | 5/1979 | Stafford | 405/202 |
| 4,700,017 | A * | 10/1987 | Morand | 174/86 |
| 4,797,019 | A * | 1/1989 | Wood, Jr. | 403/133 |
| 5,003,837 | A * | 4/1991 | Italiano | 74/501.5 R |
| 5,303,136 | A * | 4/1994 | Brown | 362/421 |
| 5,391,014 | A * | 2/1995 | Chen | 403/74 |
| 5,624,198 | A * | 4/1997 | Fuchs | 403/76 |
| 5,979,350 | A | 11/1999 | Larson et al. | |
| 6,168,341 | B1 * | 1/2001 | Chene et al. | 403/76 |
| 6,328,270 | B1 * | 12/2001 | Elberbaum | 248/288.31 |
| 6,343,888 | B1 * | 2/2002 | Huhn et al. | 403/133 |
| D465,194 | S | 11/2002 | Eck | |
| 2004/0180616 | A1 * | 9/2004 | Loveless | |

* cited by examiner

*Primary Examiner*—Daniel P Stodola
*Assistant Examiner*—Nahid Amiri
(74) *Attorney, Agent, or Firm*—Nixon & Vanderhye P.C.

(57) ABSTRACT

A joint system enables pivotable coupling between a first frame member and a second frame member. The joint system includes a mounting ball assembly affixable to the first frame member, and a connector engageable with the mounting ball assembly at one end and affixable to the second frame at an opposite end. The connector is constructed such that it is movable on the mounting ball assembly in a folding plane and through a clearance amount in a clearance plane substantially perpendicular to the folding plane. A continuous passage is defined through the mounting ball assembly and the connector.

15 Claims, 4 Drawing Sheets

JOINT SYSTEM

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to a joint system pivotally connecting a first frame member to a second frame member and, more particularly, to a joint system including a mounting ball assembly and connector constructed to enable free movement in a folding plane with a clearance amount in a clearance plane generally perpendicular to the folding plane.

A wakeboard tower is a boat accessory typically extending above and across the passenger cabin over the windshield. The tower is designed to support a tow rope for a wakeboard rider. Typically, the wakeboard tower is comprised of tubular frame elements formed of a sturdy material such as aluminum securely fixed at four points to the boat hull. See, for example, U.S. Pat. Nos. D465,194 and 5,979,350, the contents of which are hereby incorporated by reference.

There are, however, a number of problems with existing wakeboard tower systems. In some arrangements, the wakeboard towers, once installed, are difficult to remove or are unable to be pivoted into a stowed position. With a system configured for pivotable stowage, in order to ensure proper installation, manufacturing tolerances must be tightened so that the hinge points properly align with one another. Still further, wakeboard towers may also support lights or other components requiring power, and thus, wires must be accommodated. In this context, however, at the hinge points, the wires are typically exposed and are subject to wear through catching or the like or exposure to the harsh marine environment.

BRIEF SUMMARY OF THE INVENTION

It would thus be desirable to provide a hinge system to facilitate a connection between a wakeboard tower or other frame member to a frame portion of a boat, such as the windshield frame. By using a mounting ball assembly, strict alignment is not required, thereby loosening manufacturing tolerances and reducing manufacturing costs. A clearance amount on either side of the folding path accommodates angular and rotational misalignment. The system may also provide for the passage of wires or hoses within the joint to overcome those problems associated with exposed wires.

In an exemplary embodiment of the invention, a joint system movably couples a first frame member to a second frame member. The joint system includes a mounting ball assembly affixable to the first frame member, and a connector engageable with the mounting ball assembly at one end and affixable to the second frame at an opposite end. Preferably, the connector is constructed such that it is movable on the mounting ball assembly in a folding plane and through a clearance amount, such as +/−10°, in a clearance plane substantially perpendicular to the folding plane. A continuous passage is defined through the mounting ball assembly and the connector.

The mounting ball assembly preferably includes a mounting stub having a fixing end coupleable with the first frame member and a coupling end; a mounting ball member including a mounting ball, a mounting ball shaft, and a mounting ball base; and a mounting collar sized to fit over the mounting ball base and including structure that engages the coupling end of the mounting stub. In this context, the connector may define a ball receiving chamber via facing complementary part-spherical shaped extensions, wherein when assembled, ends of the extensions are spaced wider than the mounting ball shaft to effect the clearance amount. Preferably, the mounting stub coupling end is threaded, wherein the mounting collar includes corresponding internal threads coupleable with the coupling end of the mounting stub.

The connector may be composed of a swivel connector affixable at one end to the second frame member and a swivel connector cap affixable to the swivel connector. The swivel connector cap and an opposite end of the swivel connector define the ball receiving chamber. Preferably, the swivel connector cap is securable to the swivel connector via at least one fastener.

In one arrangement, the first frame is a boat windshield frame, and the second frame is a boat accessory, such as a wakeboard or water ski tower.

In another exemplary embodiment of the invention, a joint system for pivotally connecting a first frame member to a second frame member includes a mounting ball assembly affixable to the first frame member; and a connector engageable with the mounting ball assembly at one end and affixable to the second frame at an opposite end. The connector preferably includes a swivel connector affixable at one end to the second frame member and a swivel connector cap affixable to the swivel connector. The swivel connector cap and an opposite end of the swivel connector define a ball receiving chamber via facing complementary part-spherical shaped extensions, respectively, sized to receive a mounting ball of the mounting ball assembly for pivotable movement in a folding plane. When assembled, ends of the extensions are spaced an amount to effect a clearance amount in a clearance plane substantially perpendicular to the folding plane.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
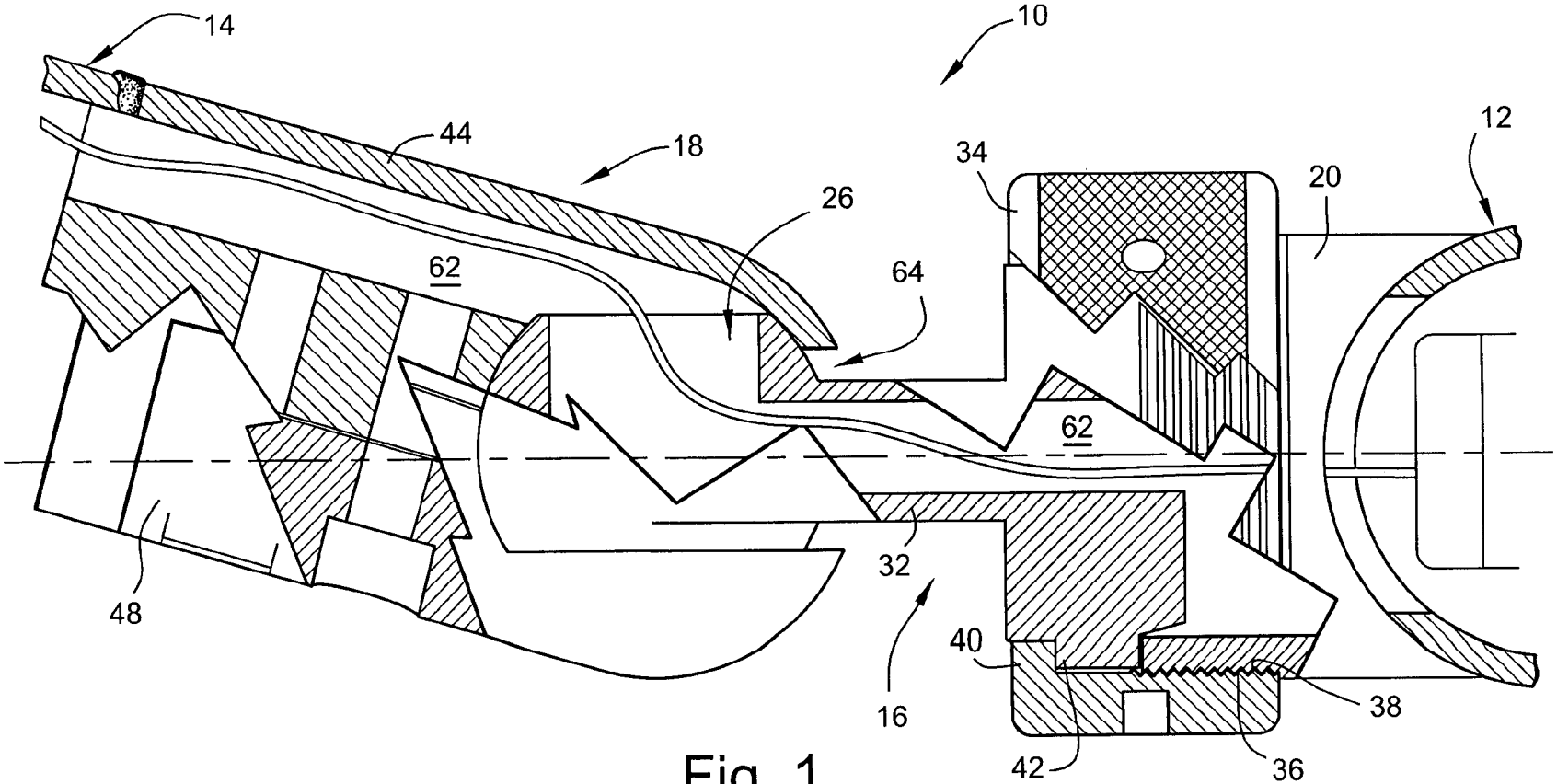
FIG. 1 is a sectional view of the joint system of the present invention.

FIG. 1 is a cross sectional view of the joint system 10 according to the present invention. As shown, the joint system 10 provides a pivotable connection between two frame members, which need not necessarily be similarly oriented. In the exemplary embodiment illustrated in FIG. 1, the joint system 10 is connected between a portion of a windshield frame 12 and a tower leg 14 of a wakeboard tower. The joint system is affixed between the frame members (e.g., windshield frame 12 and tower leg 14) via any suitable means such as welding.

As noted, the embodiment illustrated in FIG. 1 is exemplary, and the joint system 10 can provide a pivotable connection between any two members.

The joint system 10 includes a mounting ball assembly 16, which is affixable to the first frame member 12. A connector 18 is engageable with the mounting ball assembly 16 at one end and is affixable to the second frame 14 at an opposite end.

Figure 3B:
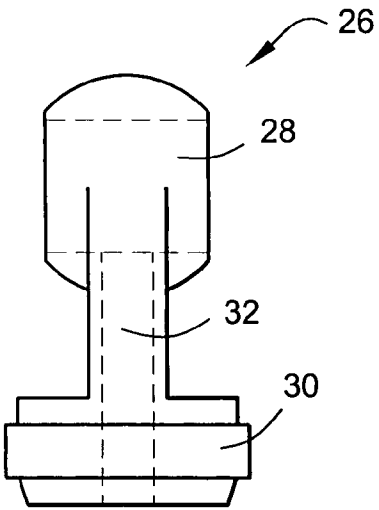
FIGS. 3A and 3B are side and end views, respectively, of the mounting ball.
Figure 3A:
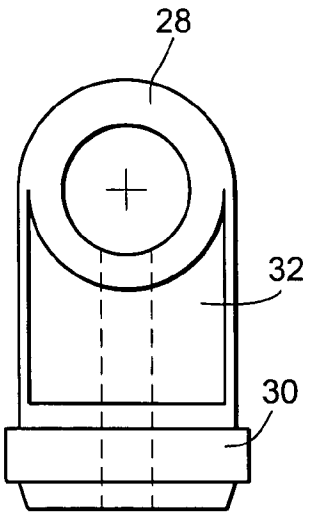
Figure 2:
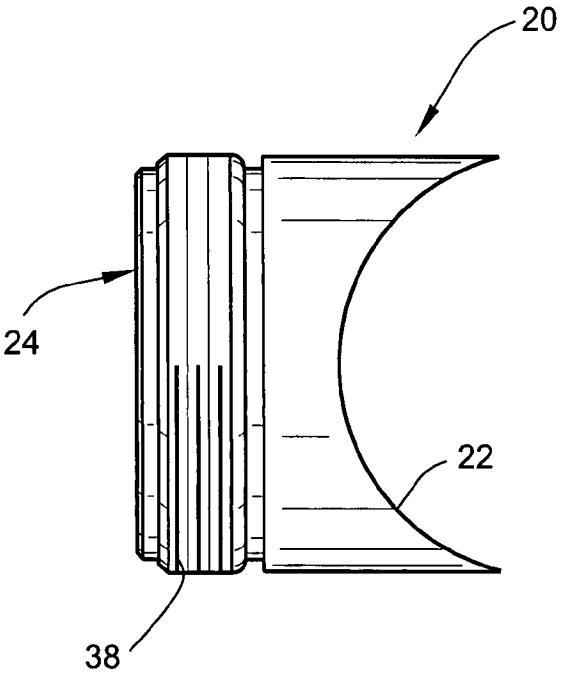
FIG. 2 is a side view of the mounting stub part of the mounting ball assembly.
Figure 4B:
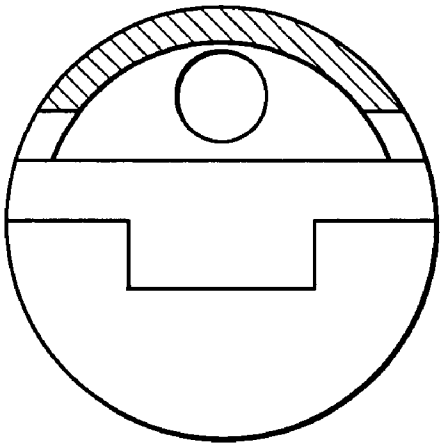
FIGS. 4A and 4B show the swivel connector.
Figure 4A:
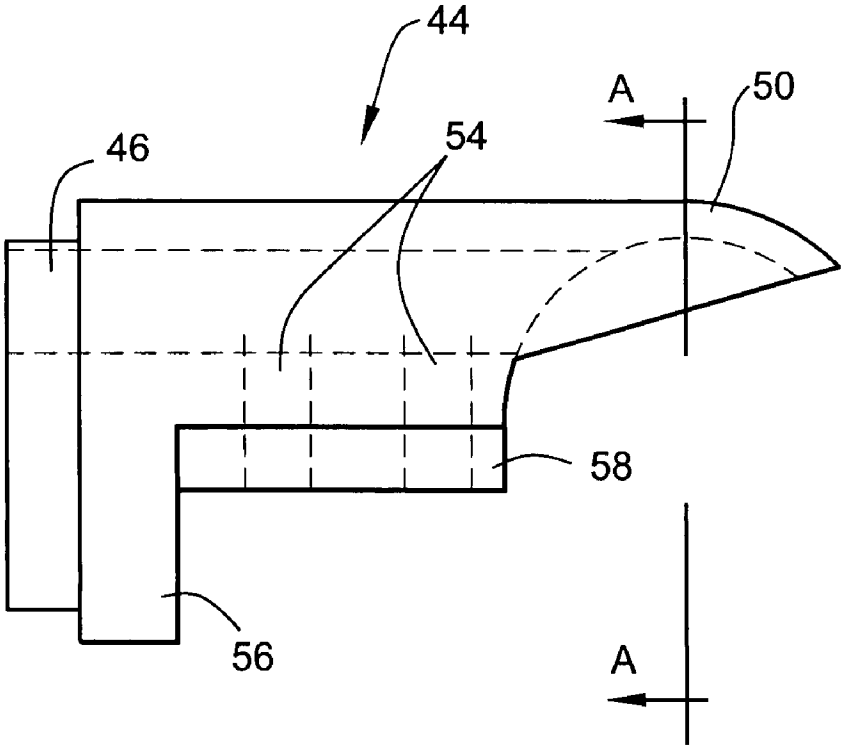
Figure 5B:
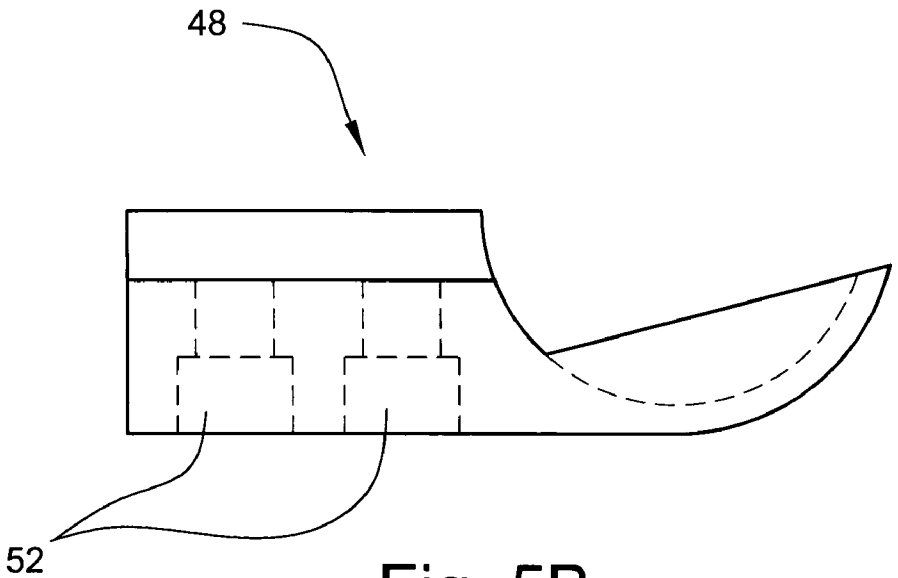
FIGS. 5A and 5B show the swivel connector cap.
Figure 5A:
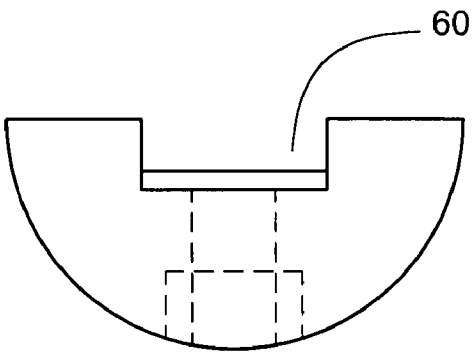

With continued reference to FIG. 1 and with reference to FIGS. 2-3B, the mounting ball assembly 16 includes a mounting stub 20 having a fixing end 22 coupleable, via welding or the like, with the first frame member 12 and a coupling end 24. A mounting ball member 26 includes a mounting ball 28 integrated with a mounting ball base 30 via a mounting ball shaft 32. A mounting collar 34 is sized to fit over the mounting ball base 30 and engage the coupling end 24 of the mounting stub 20.

As shown in FIG. 1, in an exemplary arrangement, the mounting collar 34 is provided with internal threads 36 that engage corresponding threads 38 on the mounting stub 20. The mounting collar 34 includes a shoulder section 40 that engages an annular boss 42 on the mounting ball base 30. As the mounting collar 34 is threaded over the mounting stub 20, the shoulder 40 engages the annular boss 42 to secure the mounting ball member 26 in place.

With continued reference to FIG. 1 and with reference to FIGS. 4A-5B, the connector 18 includes a swivel connector 44 affixable at one end 46 to the second frame member 14, and a swivel connector cap 48 affixable to the swivel connector 44. The swivel connector cap 48 and an opposite end 50 of the swivel connector 44 define a ball receiving chamber sized to receive the mounting ball 28 of the mounting ball assembly 26. Preferably, the swivel connector cap 48 is secured to the swivel connector 44 via at least one fastener such as a screw or rivet through corresponding openings 52 in the swivel connector cap and openings 54 in the swivel connector. The swivel connector 44 also includes a supporting shelf 56 and an engagement boss 58 to facilitate alignment and connection of the swivel connector cap 48. The swivel connector cap 48 is provided with a channel 60 that engages the engagement boss 58 when the swivel connector and swivel connector cap are coupled together. A continuous passage or opening 62 is defined through the mounting ball assembly 16 and the connector 18 as shown. The passage 62 accommodates wires for components mounted on the tower.

As shown, the swivel connector cap 48 and the opposite end 50 of the swivel connector define the ball receiving chamber via facing complementary part-spherical shaped extensions, respectively. A thin plastic liner may be mounted to the inside of the ball receiving chamber to provide for smooth folding and to absorb slight manufacturing tolerances. When assembled, ends of the part-spherical shaped extensions are spaced from each other by an amount slightly wider than a width of the mounting ball shaft 32. As a consequence, the mounting ball assembly 16 is pivotable relative to the connector 18 preferably through at least 120° in a folding plane (perpendicular to the plane of the paper in FIG. 1). Additionally, by virtue of the spaced extension ends, a clearance amount 64, preferably about ± 10°, is effected in a clearance plane (parallel with the paper plane in FIG. 1) substantially perpendicular to the folding plane.

Although the joint system of the present invention is illustrated for mounting a wakeboard (or other) tower on a wing window of a boat windshield, the system can be used for many other applications as would be apparent to those of ordinary skill in the art. By using the mounting ball assembly, strict alignment is not required, thereby enabling manufacturing tolerances to be relaxed resulting in reduced manufacturing costs. The system additionally incorporates a ±10° clearance amount on either side of the folding path to allow for angular and rotational misalignment. Still further, the design allows for the passage of wires, which thus prevents the wires from being caught or from being exposed to the marine environment. The mounting collars allow one end of the tower to be released for folding or both ends to be released for complete removal. The large size of the collar/ball section to wing connection allows the use of multi-lead electrical connectors, which simplifies manufacturing and installation/removal of the tower. Covers may also be supplied for the portion of the fitting welded to the windshield for use when the tower is removed.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A joint system movably coupling a first frame member to a second frame member, the joint system comprising:

a mounting ball assembly including a mounting ball base immovably affixable to the first frame member and a mounting ball immovably secured relative to the mounting ball base and separated from the mounting ball base by a mounting ball shaft;

a connector secured to the mounting ball assembly at one end and affixable to the second frame member at an opposite end, the connector being pivotable on the mounting ball to effect the movable coupling between the first frame member and the second frame member, and the connector maintaining contact with the mounting ball assembly during pivoting regardless of a position of the connector relative to the mounting ball assembly, wherein the connector is constructed such that it is movable on and relative to the mounting ball assembly by a first maximum amount in a folding plane and through a clearance plane by a second maximum amount in a transverse plane substantially perpendicular to the folding plane, and wherein the first maximum amount is larger than the second maximum amount; and a continuous passage defined through the mounting ball assembly and the connector, the continuous passage being continuous regardless of a position of the connector relative to the mounting ball assembly.

2. A joint system according to claim 1, wherein the connector comprises a swivel connector affixable at one end to the second frame member and a separate swivel connector cap affixable to the swivel connector, the swivel connector cap and an opposite end of the swivel connector defining a ball receiving chamber sized to receive the mounting ball of the mounting ball assembly.

3. A joint system according to claim 2, wherein the swivel connector cap is securable to the swivel connector via at least one fastener.

4. A joint system according to claim 2, wherein the swivel connector cap and the opposite end of the swivel connector define the ball receiving chamber via facing complementary part-spherical shaped extensions, respectively, and wherein when assembled, ends of the extensions are spaced an amount to effect the wide folding path.

5. A joint system according to claim 4, wherein the second amount is +/−10°.

6. A joint system according to claim 1, wherein the connector defines a ball receiving chamber via separate facing complementary part-spherical shaped extensions, and wherein when assembled, ends of the extensions are spaced an amount to effect the wide folding path.

7. A joint system according to claim 6, wherein the second amount is +/−10°.

8. A joint system according to claim 1, wherein the connector is constructed such that the first amount is at least 120°.

9. A joint system according to claim 1, wherein the continuous passage extends through the mounting ball shaft along a first axis and through a side of the mounting ball along a second axis substantially perpendicular to the first axis.

10. A joint system movably coupling a first frame member to a second frame member, the joint system comprising:

a mounting ball assembly affixable to the first frame member;

a connector engageable with the mounting ball assembly at one end and affixable to the second frame member at an opposite end, wherein the connector is constructed such that it is movable on the mounting ball assembly by a first maximum amount in a folding plane and through a clearance plane by a second maximum amount in a transverse plane wherein the first maximum amount is larger than the second maximum amount substantially perpendicular to the folding plane; and a continuous passage defined through the mounting ball assembly and the connector, wherein the mounting ball assembly comprises:

a mounting stub having a fixing end coupleable with the first frame member and a coupling end;

a mounting ball member including a mounting ball, a mounting ball shaft, and a mounting ball base; and a mounting collar sized to fit over the mounting ball base and including structure that engages the coupling end of the mounting stub.

11. A joint system according to claim 10, wherein the connector defines a ball receiving chamber via facing complementary part-spherical shaped extensions, and wherein when assembled, ends of the extensions are spaced wider than the mounting ball shaft to effect the wide folding path.

12. A joint system according to claim 10, wherein the mounting stub coupling end is threaded, and wherein the mounting collar comprises corresponding internal threads coupleable with the coupling end of the mounting stub.

13. A joint system for pivotally connecting a first frame member to a second frame member, the joint system comprising:

a mounting ball assembly including a mounting ball base immovably affixable to the first frame member and a mounting ball immovably secured relative to the mounting ball base and separated from the mounting ball base by a mounting ball shaft; and a connector secured to the mounting ball assembly at one end and affixable to the second frame member at an opposite end, the connector being pivotable on the mounting ball to effect the movable coupling between the first frame member and the second frame member, and the connector maintaining contact with the mounting ball assembly during pivoting regardless of a position of the connector relative to the mounting ball assembly, wherein the connector comprises a swivel connector affixable at one end to the second frame member and a separate swivel connector cap affixable to the swivel connector, the swivel connector cap and an opposite end of the swivel connector defining a ball receiving chamber via facing complementary part-spherical shaped extensions, respectively, sized to receive the mounting ball of the mounting ball assembly for pivotable movement by a first maximum amount in a folding plane, and through a clearance plane by a second maximum amount in a transverse plane substantially perpendicular to the folding plane, and wherein the first maximum amount is larger than the second maximum amount.

14. A joint system according to claim 13, wherein the second amount is +/−10°.

15. A joint system according to claim 13, further comprising a continuous passage defined through the mounting ball assembly and the connector.

* * * * *